US006559584B2

(12) United States Patent
Vriens

(10) Patent No.: US 6,559,584 B2
(45) Date of Patent: May 6, 2003

(54) CRT WITH IMPROVED SLOTTED MASK

(75) Inventor: Leendert Vriens, Knegsel (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 103 days.

(21) Appl. No.: 09/811,643

(22) Filed: Mar. 19, 2001

(65) Prior Publication Data

US 2001/0028210 A1 Oct. 11, 2001

(30) Foreign Application Priority Data

Mar. 20, 2000 (EP) ..... 00201008

(51) Int. Cl.[7] ..... H01J 29/80
(52) U.S. Cl. ..... 313/402
(58) Field of Search ..... 313/402, 403, 313/404, 405, 406, 407, 408

(56) References Cited

U.S. PATENT DOCUMENTS 4,048,536 A * 9/1977 Brown ..... 313/403
4,159,177 A * 6/1979 Elshof et al. ..... 313/403
4,942,332 A 7/1990 Adler et al. ..... 313/402
6,133,682 A * 10/2000 Murai et al. ..... 313/403
6,407,490 B1 * 6/2002 Shin et al. ..... 313/402
6,420,054 B1 * 7/2002 Cozar et al. ..... 428/682

* cited by examiner

*Primary Examiner*—David Martin
*Assistant Examiner*—Thanh S. Phan
(74) *Attorney, Agent, or Firm*—Aaron Waxler

(57) ABSTRACT

The CRT has a tensioned shadow mask with between 160–180 or between 210 and 240 slits per row and display devices having such CRT's. The first embodiment is in particular suited for CRT''s having a screen size larger than 21" and for TVT applications, giving a substantially Moire free image for an NTSC, PAL and VGA signal, the second embodiment is in particular suited for CRT's having a screen size of 23" or smaller and for CMT applications, giving a substantially Moire free image for a SVGA and XGA signal.

15 Claims, 2 Drawing Sheets

CRT WITH IMPROVED SLOTTED MASK

BACKGROUND OF THE INVENTION

1. Field of the Invention

The invention relates to a CRT (cathode ray tube) with a colour selection electrode having rows of elongated openings. The colour selection electrode is also called a 'mask'. More in particular it relates to a CRT with a tensioned colour selection electrode in which tension is applied in a direction and the colour selection electrode comprises openings elongated in said direction, the openings being separated from each other in said direction by bridges.

2. Description of the Prior Art

In U.S. Pat. No. 4,942,332 a slit-type flat foil tension mask is described having slits with large (in comparison to conventional masks) longitudinal dimensions. Typically the length of the slits is of the order of 1 inch (2.5 cm). The distance between bridges between slits is sometimes also called the vertical pitch or in short $a_v$.

The bridges in between the slits provide mechanical strength to the tensioned colour selection electrode, without substantially reducing the image brightness or deforming the mask when the mask is put under tension. However, they also pose a problem in that the bridges may be visible as two straight horizontal lines, reducing the image quality.

In U.S. Pat. No. 4,942,332 a solution for this problem is described, being constituted by randomising the length (pitch) of the slits.

It is proposed in 'Stretched tension mask with large vertical pitch for CMTs' IDW 99, page 573–576 to use, in order to remove or at least reduce, the visibility of the bridges a vertical pitch from 2.4 mm to 6 mm for a 21" CRT. Smaller vertical pitches (between 1 and 2.4 mm) provide large Moire patterns and are thus excluded.

Both of these solutions, however, have shortcomings, in both the visibility of the bridges is still appreciable.

SUMMARY OF THE INVENTION

The inventors have realised that randomisation of the position of the bridges as described in U.S. Pat. No. 4,942,332 leads to unexpected problems. At some parts of the image the bridges become visible, namely there where a number of bridges happen to be at the same horizontal position, or where adjacent bridges happen to be spaced at such distances that Moiré effects occur, where at other parts they are not. The randomisation in fact does not change the distance between the bridges seen in a horizontal dimension by a large amount. The randomisation as described in U.S. Pat. No. 4,942,332 is for example 0.02', which means that on average the distance between adjacent bridges is 0.01' or 0.25 mm, and because of the randomisation the distance is sometimes much less. This still leads to lines being visible in the image, to which lines the human eye is very sensitive. Randomising invariantly also leads to clustering, resulting being visible in parts of the image. The human eye is very sensitive to such irregularities in the image. The image is perceived as 'patchy' because of this effect. In some sense this problem is a greater problem than a straight line being visible. The straight line is always there and it is a problem that the viewer understands and will most likely be at least to some degree be visible when the device is bought and will effect all modes of image reproduction in more or less the same degree. The 'patchy' image due to randomisation is something that is dependent of the image that is displayed, and also on the particular mode (VGA, UGA, XVGA etc) with which the image is displayed. These problems become usually visible at higher solution of the image, i.e. the higher the image quality. Such problems manifest themselves more often than not after sale and effect in particular the high quality image modes, leading to the clearly unwanted effect that the 'lower image quality' in fact gives a higher quality image than the 'high quality image'.

A vertical pitch between 2.4 and 6 mm (as in the above cited article) does reduce the visibility of the bridges, but they are nevertheless visible, especially in a CMT (Colour Monitor Tube, that is a CRT for a computer monitor).

The present invention has as an object to provide a CRT in which some or most of the above cited problems are resolved or reduced, more in particular to provide a CRT in which the presence of the bridges is less noticeable.

To this end the CRT in accordance with the invention is characterised in that the number of slits per row lies between 160 and 180 slits per row for a diagonal dimension of the CRT equal to or larger than 21" or between 210 and 240 for a diagonal dimension smaller than 23".

The inventors have realised that, although the resulting vertical pitch or pitches is for a 21" CRT well within the range for which in the cited article Moire patterns are predicted, the indicated range surprisingly enough provide for a CRT which, when used for either TVT or CMT application shows little or no Moire patterns, while yet offering increased intensity of the image, and strong masks, but no visible effects of individual bridges.

The first indicated embodiment (the number of slits per row lying between 160 and 180 slits per row for a diagonal dimension of the CRT equal to or larger than 21") provides a CRT which shows little or no Moire for an NTCS or PAL or VGA signal and only small Moire for an SVGA signal as will be explained below. NTSC, PAL and to a lesser degree VGA signal are typically signals for TVT applications. The size of the CRT (larger than 21") makes for a comfortable viewing distance (roughly three to seven times the height of the image) at which viewing distance the resulting distance between the bridges is such that individual bridges are no longer or less visible.

The second embodiment provides for a CRT which shows little or no Moire for an SVGA or XGA signal which are signals typical for CMT applications. For such applications the viewing distances are typically smaller, but because the number of slits (as compared to the first embodiment) is also increased, visibility of individual bridges is still small.

The invention is amongst others based on the insight that, although in general Moire patterns do indeed cause severe Moire patterns in the range (1 to 2.4 mm) indicated in the cited article, the ranges of the embodiments of the present inventions do not show appreciable Moire patterns. Namely, in the range from 1 to 2.4 mm there is a substantial variation in the intensity and wavelengths of the Moire patterns. In the range of the embodiments of the present invention the Moire intensities are lowest and the Moire is least visible.

Preferably the height of the bridges is for the first embodiment less than 100 micrometer, for the second embodiment less than 70 micrometer.

The inventors have released that, for tension masks with relatively large slits as in the present invention, the height of the bridges may be considerably less than the height of the bridges in conventional shadow masks, which lie around 140 micrometer. This reduction in height reduces the negative influences of the bridges on the image intensity and Moire patterns, thus increasing the image quality.

The invention furthermore relates to a cathode ray tube for TVT applications with a tensioned colour selection electrode in which electrode tension is applied in a direction and the colour selection electrode comprises elongated openings in said direction, the openings being separated from each other in said direction by bridges, characterised in that the number of slits per row lies between 160 and 180 slits per row and to a cathode ray tube for CMT applications with a tensioned colour selection electrode in which electrode tension is applied in a direction and the colour selection electrode comprises elongated openings in said direction, the openings being separated from each other in said direction by bridges, characterised in that the number of slits per row lies between 210 and 240 slits per row.

It is remarked that 'for TVT applications' and 'for CMT applications' in the art of CRT's is more than an indication of possible use. CRT's are specifically made for such applications, in fact the international code for CRT's indicates (by means of an M) which CRT's are for CMT applications. Furthermore CRT's for CMT applications have to comply with certain radiation requirements (due to the relatively small viewing distance) and safety requirements whereas CRT's for TVT applications have less stringent requirements. Handbooks and brochures also specifically indicate which CRT's are for which application.

The invention also relates to a TVT comprising a cathode ray tube with a tensioned colour selection electrode in which electrode tension is applied in a direction and the colour selection electrode comprises elongated openings in said direction, the openings being separated from each other in said direction by bridges, characterised in that the number of slits per row lies between 160 and 180 slits per row.

The invention also relates to a CMT comprising a cathode ray tube with a tensioned colour selection electrode in which electrode tension is applied in a direction and the colour selection electrode comprises elongated openings in said direction, the openings being separated from each other in said direction by bridges, characterised in that the number of slits per row lies between 210 and 240 slits per row.

'Between x and y' includes within the framework of the invention a number of y (or y) slits. Within the framework of the invention some of the outermost rows may have a smaller number of slits.

BRIEF DESCRIPTION OF THE DRAWINGS

These and other aspects of the invention are apparent from and will be elucidated in greater detail by way of example and with reference to the accompanying drawings in which FIG. 1 schematically shows a CRT.

The Figures are not drawn to scale. In general, like reference numerals refer to like parts.

DETAILED DESCRIPTION OF THE INVENTION

Figure 1:
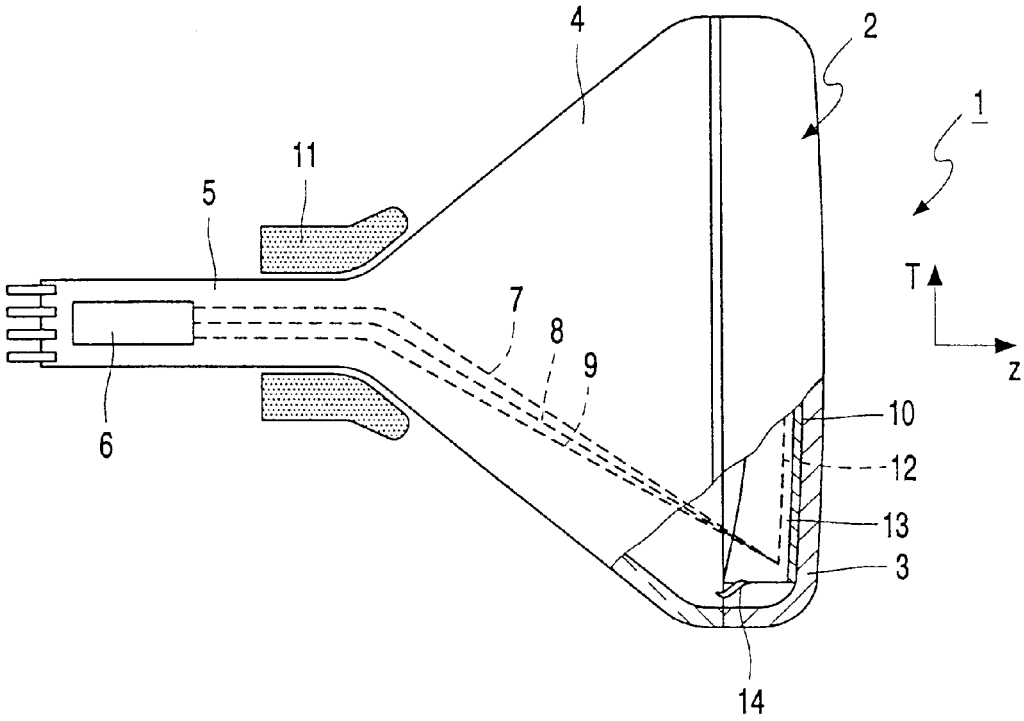

A color display device 1 (FIG. 1) includes an evacuated envelope 2 comprising a display window 3, a cone portion 4 and a neck 5. In said neck 5 there is provided an electron gun 6 for generating three electron beams 7, 8 and 9. A display screen 10 is present on the inside of the display window. Said display screen 10 comprises a phosphor pattern of phosphor elements luminescing in red, green and blue. On their way to the display screen the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges on phosphor elements of only one color. In FIG. 1 the axis (z-axis) of the envelope is also indicated.

Figure 2:
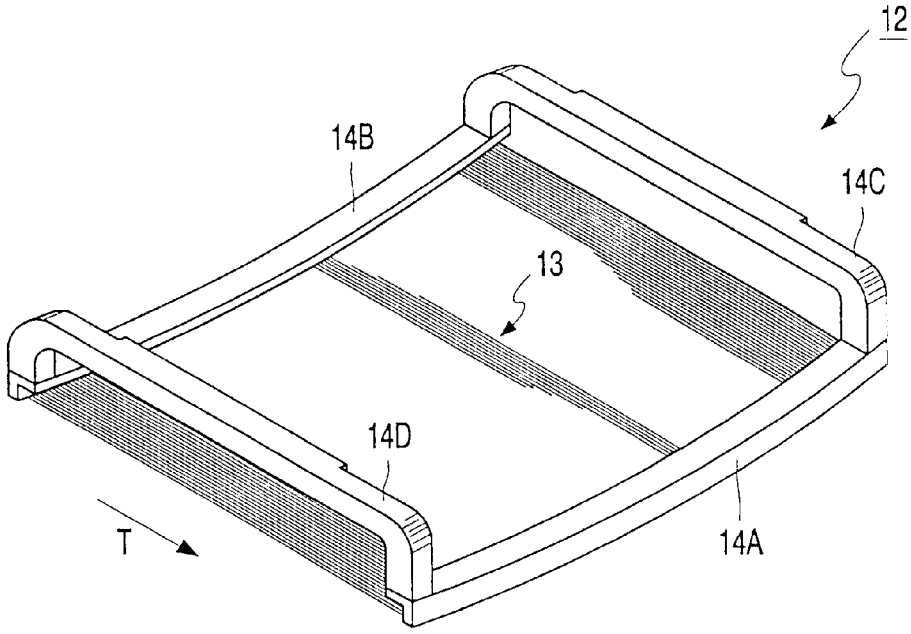
FIG. 2 shows schematically a tensioned colour selection electrode.

FIG. 2 shows schematically a tensioned color selection electrode. The color selection electrode comprises a frame 14, having attachment sides 14A and 14B and sides 14C and 14D perpendicular to the attachment sides 14A and 14B. Before the mask is provided the sides 14A and 14B are pushed inwards. When the mask is attached and the pushing force is released, the mask is put under tension. The direction of tension T is indicated in FIG. 2.

Figure 3:
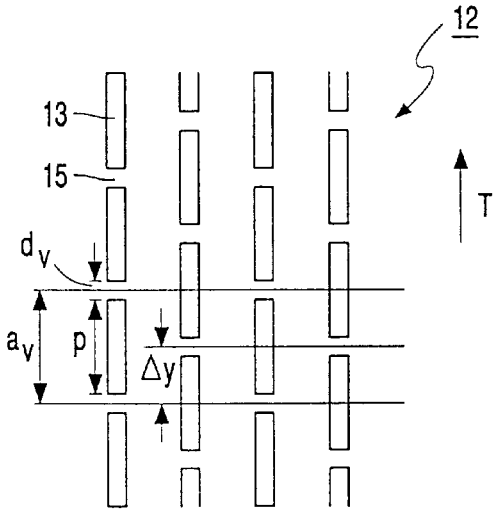
FIG. 3 shows schematically a part of a shadow mask, showing the elongated slits and the bridges.

FIG. 3 shows schematically slits 13 in shadow mask 12.

The slits are elongated in direction T. The vertical pitch $a_v$ is schematically shown. The slits 13 are separated from each other (in the direction T) by bridges 15. The bridge height $d_v$ is also indicated in FIG. 3, as well as the slit length p. The following relation holds:

$$a_v = d_v + p.$$

Adjacent rows are offset by a distance Δy. As can be seen in FIG. 3 all bridges lie in this example at a set of parallel lines. When $a_v$ becomes large these lines of bridges become visible to the naked eye. Randomization of Δy reduces the visibility of the lines as such, but introduces patchiness of the image.

The CRT in accordance with the invention is characterized in that the number of slits per row lies between 160 and 180 slits per row for a diagonal dimension of the CRT equal to or larger than 21" or between 210 and 240 for a diagonal dimension smaller than 23".

Moire patterns are due to an interference effect between the scan lines (with a scan pitch s) and the pattern of openings (with a vertical pitch $a_v$). The inventors have realized that there is a relatively small range of $s/a_v$ values between 4/8 and 2/8, namely between 3.2/8 and 2.4/8 within which the Moire patterns are small to negligible. It is remarked that the centre of this range is not 3.0/8 but more towards 2/8 than towards 4/8.

For first range of number of apertures (160–180) the $s/a_v$ ratio for a NTSC, a PAL and a VGA signal are all within 2.4/8 and 3.2/8. This first embodiment provides a CRT which on the one hand has a considerable larger image intensity (because the number of bridges is strongly reduced from the usual number which lies in the order of 500), with a typical gain in intensity of 10–20%, while yet providing an image substantially free from moire for NTCS, PAL and VGA signals, which are signals typically used in TVT applications. The number of lines is relatively small, but sufficient since for TVT applications the viewing distance is relatively large (roughly 2 meter or more) as are the CRT sizes (typically larger than 21").

For second range of number of apertures (210–240) the $s/a_v$ ratio for a SVGA and XGA signal are within 2.4/8 and 3.2/8. This second embodiment provides a CRT which on the one hand has a considerable larger image intensity (because the number of bridges is strongly reduced from the usual number which lies in the order of 500), with a typical gain in intensity of 10–20%, while yet providing an image substantially free from moire for SVGA and XGA signals, which are signals typically used in CMT applications. The number of lines is relatively large, since for CMT applications the viewing distance is relatively small (0.5 to slightly more than 1 meter) as are the CRT sizes (equal or less than 23").

Figure 4:
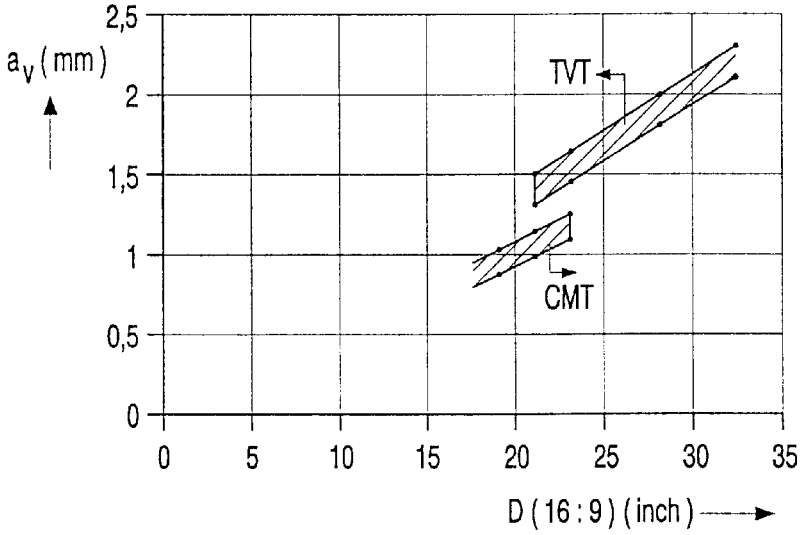
FIG. 4 shows as a function of diagonal size D for a 16:9 tube the vertical pitch $a_v$ for CRTs in accordance with the invention.

FIG. 4 shows graphically and approximately $a_v$ as a function of the diagonal size of the CRT for a 16:9 tube. The indicated ranges are although giving a good indication, indicative firstly because not all CRT which have the same nominal size actually have the same size and secondly because the distance between the mask and the phosphor screen and the angle of deflection of the electron beams have some influence on the relation between screen size and $a_v$ value.

Figure 5:
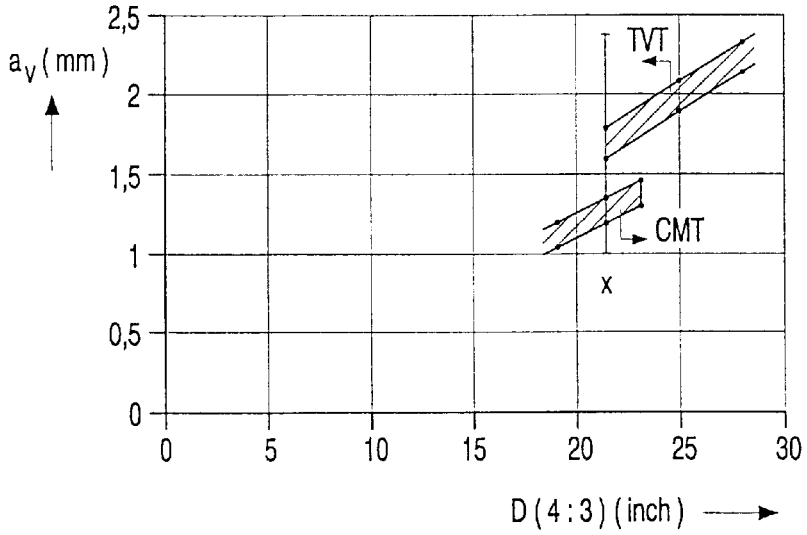
FIG. 5 shows as a function of diagonal size D for a 4:3 tube the vertical pitch $a_v$ for CRTs in accordance with the invention.

FIG. 5 shows graphically and approximately $a_v$ as a function of the diagonal size of the CRT for a 4:3 tube. Again, as in FIG. 4, the indicated ranges form an indication. Also given is the range for a 21" CMT which according to the article 'Stretched tension mask with large vertical pitch for CMT's' IDW 99, page 573–576' provide for large Moire problems. The inventors have released that, although in general the indicated range indeed provide for large Moire problems, there is nevertheless, and this is formed by the ranges of the invention, some particular sub-ranges for which Moire problems do not occur. The cross in FIG. 5 indicate the value for $a_v$ mentioned in the cited article as optimal for NTCS and PAL.

It will be clear that within the framework of the invention many variations are possible. For instance, the height of the bridges is preferably reduced substantially in respect to conventional values which lie around 140 micrometer.

Preferably the height of the bridges is for the first embodiment (160–180 bridges) less than 100 micrometer, for the second embodiment (210–240 bridges) less than 70 micrometer. For tensioned masks the height of the bridges can be reduced substantially in respect of the height for conventional (non-tensioned) masks. This reduction reduces the visibility of the bridges, increases the image intensity, and has some positive effect on any residual Moire effects.

Also, for instance, not all of the bridges need to be full bridges, i.e. attached to the mask at both sides. In embodiments it is possible that some (for instance 2 of every three) of the bridges span a substantial part of the slit (for instance 50–75%), bot not the whole slit. Although the strength of the mask increased as the number of bridges increases (which thus would favour all bridges forming mechanical connections), the effect of the invention (reduction of visibility of the bridges) is also apparent when some of the bridges are false bridges as long as the total number of true and false bridges lies within the indicated numbers. The advantage of using false bridges lies in a further increased image intensity.

In short the invention can be described as follows. The CRT in accordance with the invention has a tensioned shadow mask with between 160–180 or between 210 and 240 slits per row and display devices having such CRT's. The first embodiment is in particular suited for CRT''s having a screen size larger than 21" and for TVT applications, giving a substantially Moire free image for an NTSC, PAL and VGA signal, the second embodiment is in particular suited for CRT's having a screen size of 23" or smaller and for CMT applications, giving a substantially Moire free image for a SVGA and XGA signal.

What is claimed is:

1. Cathode ray tube with a tensioned color selection electrode in which electrode tension is applied in a direction and said tensioned color selection electrode has elongated openings in said direction, said elongated openings being separated from each other in said direction by relatively narrow bridges, wherein the number of said elongated openings per row lies either between 160 and 180 for a diagonal dimension of said cathode ray tube equal to or larger than 21" or between 210 and 240 for a diagonal dimension smaller than 23".

2. Cathode ray tube of claim 1, wherein the height of said bridges is less than 100 micrometer.

3. Cathode ray tube of claim 2, wherein the height of said bridges is less than 70 micrometer.

4. Cathode ray tube for TVT applications with a tensioned color selection electrode in which electrode tension is applied in a direction and said tensioned color selection electrode has elongated openings in said direction, said elongated openings being separated from each other in said direction by relatively narrow bridges, wherein the number of said elongated openings per row lies between 160 and 180.

5. Cathode ray tube of claim 4, wherein the height of said bridges is less than 100 micrometer.

6. Cathode ray tube of claim 5, wherein the height of said bridges is less than 70 micrometer.

7. Cathode ray tube for CMT applications with a tensioned color selection electrode in which electrode tension is applied in a direction and said tensioned color selections electrode has elongated openings in said direction, said elongated openings being separated from each other in said direction by relatively narrow bridges, the number of said elongated openings per row lies between 210 and 240.

8. Cathode ray tube of claim 7, wherein the height of said bridges is less than 100 micrometer.

9. Cathode ray tube of claim 8, wherein the height of said bridges is less than 70 micrometer.

10. TVT apparatus comprising a cathode ray tube with a tensioned color selection electrode in which electrode tension is applied in a direction and said tensioned color selection electrode has elongated openings in said direction, said elongated openings being separated from each other in said direction by relatively narrow bridges, wherein the number of said elongated openings per row lies between 160 and 180.

11. Cathode ray tube of claim 10, wherein the height of said bridges is less than 100 micrometer.

12. Cathode ray tube of claim 11, wherein the height of said bridges is less than 70 micrometer.

13. CMT apparatus comprising a cathode ray tube with a tensioned color selection electrode in which electrode tension is applied in a direction and said tensioned color selection electrode has elongated openings in said direction, said elongated openings being separated from each other in said direction by relatively narrow bridges, wherein the number of said elongated openings per row lies between 210 and 240.

14. Cathode ray tube of claim 13, wherein the height of said bridges is less than 100 micrometer.

15. Cathode ray tube of claim 14, wherein the height of said bridges is less than 70 micrometer.

* * * * *